US009724555B2

(12) United States Patent
Thomson

(10) Patent No.: US 9,724,555 B2
(45) Date of Patent: Aug. 8, 2017

(54) PORTABLE EXERCISE APPARATUS

(71) Applicant: Dion Thomson, San Diego, CA (US)

(72) Inventor: Dion Thomson, San Diego, CA (US)

( * ) Notice: Subject to any disclaimer, the term of this patent is extended or adjusted under 35 U.S.C. 154(b) by 0 days.

(21) Appl. No.: 14/970,862

(22) Filed: Dec. 16, 2015

(65) Prior Publication Data

US 2016/0175639 A1 Jun. 23, 2016

Related U.S. Application Data

(60) Provisional application No. 62/096,408, filed on Dec. 23, 2014.

(51) Int. Cl.

| | |
|---|---|
| ***A63B 21/068*** | (2006.01) |
| ***A63B 21/00*** | (2006.01) |
| ***A63B 23/12*** | (2006.01) |
| ***A63B 21/002*** | (2006.01) |
| ***A63B 21/072*** | (2006.01) |
| ***A63B 22/20*** | (2006.01) |
| ***A63B 26/00*** | (2006.01) |

(52) U.S. Cl.

CPC ..... *A63B 21/068* (2013.01); *A63B 21/002* (2013.01); *A63B 21/00069* (2013.01); *A63B 21/00185* (2013.01); *A63B 21/0724* (2013.01); *A63B 21/152* (2013.01); *A63B 21/4031* (2015.10); *A63B 21/4034* (2015.10); *A63B 21/4035* (2015.10); *A63B 22/20* (2013.01); *A63B 23/12* (2013.01); *A63B 26/003* (2013.01); *A63B 2210/50* (2013.01)

(58) Field of Classification Search

CPC ..... A63B 21/0552; A63B 21/0442; A63B 21/4035; A63B 21/068

See application file for complete search history.

(56) References Cited

U.S. PATENT DOCUMENTS 3,658,327 A * 4/1972 Thiede ..... A63B 21/068 182/116
5,967,955 A 10/1999 Westfall et al.
8,088,050 B2 1/2012 Aucamp

* cited by examiner

*Primary Examiner* — Loan H Thanh
*Assistant Examiner* — Rae Fischer
(74) *Attorney, Agent, or Firm* — Buche & Associates, P.C.; John K. Buche; Bryce A. Johnson

(57) ABSTRACT

A portable exercise device that allows a user to train the muscles in both the upper and lower body while offering a user to choose among varying amounts of resistance. The portable exercise device also allows a user to pack the entire exercise device into a compact unit that is convenient for transporting or traveling. The portable exercise device is composed of a platform, a hinged body, a base, rods, cables, and a series of handle assemblies to provide the user with the ability to perform a variety of exercises.

3 Claims, 4 Drawing Sheets

PORTABLE EXERCISE APPARATUS

CROSS-REFERENCE TO RELATED APPLICATIONS

This application claims the benefit and priority of U.S. Provisional Application Ser. No. 62/096,408, which was filed on Dec. 23, 2014 and entitled, "Portable exercise apparatus."

STATEMENT REGARDING FEDERALLY SPONSORED RESEARCH OR DEVELOPMENT

Not applicable.

BACKGROUND OF INVENTION

Field of the Invention

The subject matter of this specification is in the field of portable exercise apparatuses and related methods.

Background of the Invention

Many individuals strive to live a healthy lifestyle and achieve personal health. A healthy lifestyle involves incorporating exercise in one form or another. Many options, from workout facilities to personal home exercise equipment, exist to help individuals exercise and strengthen their muscles and cardiovascular systems. Typically, training different muscles in the upper and lower body requires a lot of different types of equipment and space. Today, individuals are finding it harder to find time to go to the gym or to find space for exercise equipment. In an attempt to limit the storage necessary and provide more convenience, companies have produced different home gym apparatuses and portable exercise devices. However, with added convenience frequently comes fewer options and decreased variety. For example, some of the portable exercise equipment available may restrict the user to just one type of exercise, or to just upper or lower body exercises. Alternatively, home gym equipment and machines that offer full body workouts are often restricted by a lack of portability. Therefore, there remains a need for an exercise apparatus that is extremely portable, yet versatile enough to accommodate a full body workout with varying resistances.

One example of a portable exercise equipment device that does not allow for a great amount of varying resistances is U.S. Pat. No. 8,088,050 by Aucamp, which discloses a portable exercise device with two resistance cords and handles. However, the amount of resistance is limited to the amount of resistance provided by an opposing arm or its associated muscles. Conversely, an example of exercise equipment that allows for a total body workout but is not portable is U.S. Pat. No. 5,967,955 by Westfall et al. (hereinafter Westfall), which discloses an exercise device that uses cables and pulleys, and utilizes different inclines to increase resistance. However, Westfall's exercise equipment is only collapsible and cannot be transported easily or used to travel.

Thus, a need exists for exercise equipment that: (1) is portable enough to fit in a travel case or under a bed; (2) has the ability to train both the upper and lower body; and (3) offers varying degrees of dynamic resistance.

SUMMARY OF THE INVENTION

In view of the foregoing, it is an object of the present invention to provide a portable exercise apparatus.

It is another object of the present invention to provide a portable exercise apparatus that features a variable amount of resistance.

It is another object of the present invention to provide a portable exercise apparatus that can accommodate a variable number of exercises.

It is another object of the present invention to provide a portable exercise apparatus that can strengthen upper and lower body muscles.

It is another object of the present invention to provide a portable exercise apparatus that can be packed up and either transported or stored in a compact area.

BRIEF DESCRIPTION OF THE FIGURES

The manner in which these objectives and other desirable characteristics can be obtained is explained in the following description and attached figures in which.

It is to be noted, however, that the appended figures illustrate only typical embodiments of the disclosed assemblies, and therefore, are not to be considered limiting in their scope, for the disclosed assemblies may admit to other equally effective embodiments that will be appreciated by those reasonably skilled in the relevant arts. Also, the figures are not necessarily made to scale.

DETAILED DESCRIPTION OF THE INVENTION

Generally, disclosed is a portable exercise apparatus that allows a user to stand on a platform and perform a variety of exercises with varying resistances. The portable exercise apparatus is easily transformable from a storable and compact unit to a full body exercise device.

Figure 1:
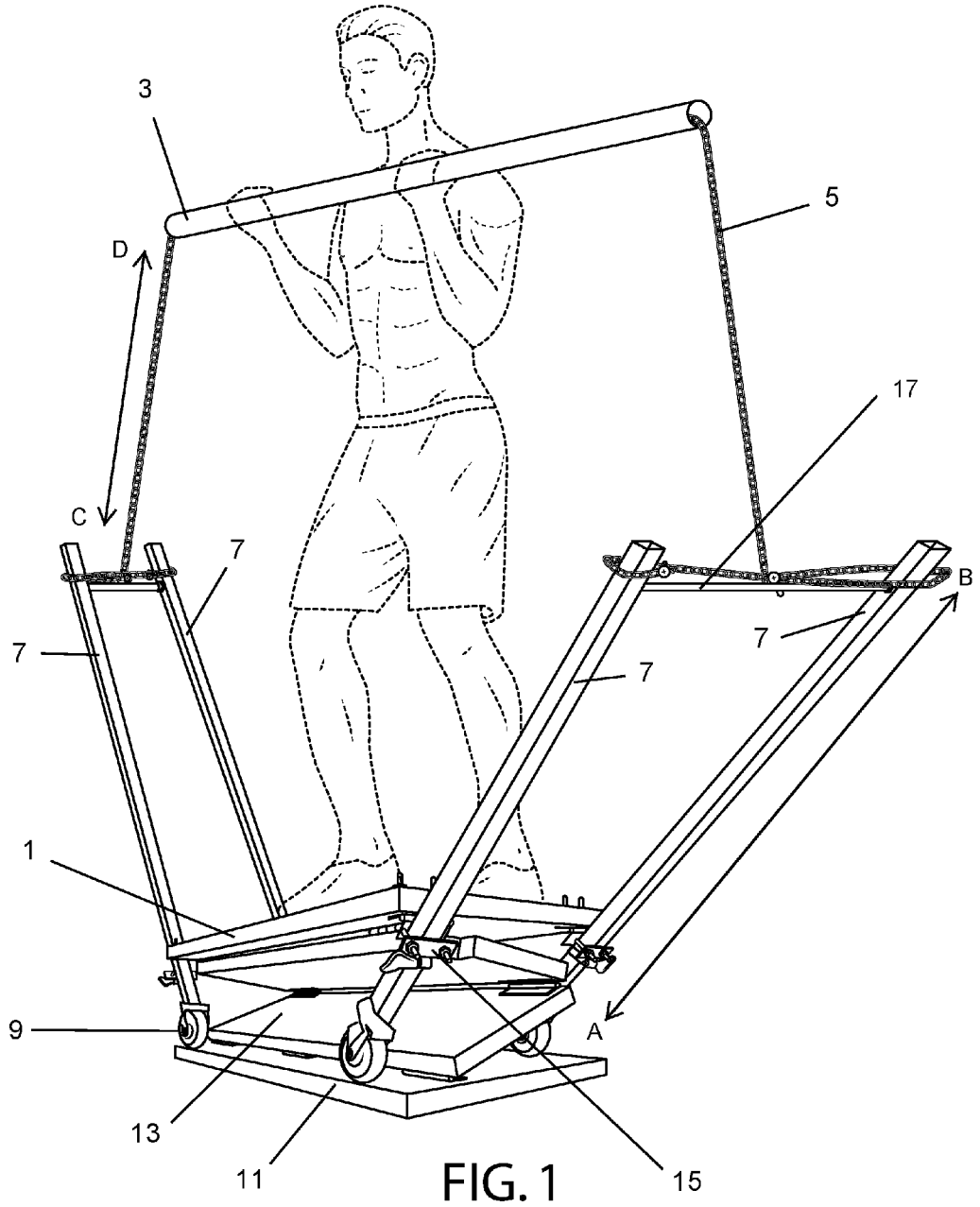
FIG. 1 is a perspective view of one embodiment of the portable exercise apparatus.

Referring to FIG. 1, in one embodiment, the portable exercise apparatus features a platform 1 with a hinged body 13 and a base 11. Furthermore, the platform 1 may feature resistance fasteners 15 at each corner of the platform 1. The resistance fasteners 15 receive and may secure the rods 7. The rods 7 may be telescoping to allow the rod 7 to retract and extend in length, which in turn increases and decreases range of movement. Additionally, the resistance fasteners 15 may be tightened at any point of the rod 7 to create a different resistance based on the length of one end of the rod 7 from a fulcrum point. The rods 7 preferably have wheels 9 attached on one end and the other end is secured to a parallel rod 7, that extends outward from a corner of the short side of a rectangular platform 1 and in line with a long edge of the platform 1, by a support segment 17 composed of metal, alloy, such as steel, or plastic, such as polycarbonate or polypropylene. The wheels 9 could also be in a guided track, slideable mechanism, or other travel mechanism. The support segment 17 may be secured by a fastener, such as screws, and nuts and bolts, or by welding each end of the support segment 17 between two parallel rods 7. Moreover, one end of a cable 5 is attached to a point along the support segment 17 between the two parallel rods 7. The other end of the cable 5 has a means for attachment for a handle assembly 3. As the apparatus is in operation, the wheels 9 roll along a top surface and outer perimeter of the base 11. As one end of the rod 7 is moved further away from a fulcrum point, the resistance against the user is increased. The fulcrum point may be anywhere along the rods 7 from A to B (See FIG. 1) depending on the amount of resistance the user desires. The point on the rod 7 that becomes the fulcrum point is disposed within the resistance fasteners 15, so that when the rod 7 moves upwards, the platform 1 on which the user is standing moves upwards as well. As the user lowers the cable 5, the rods 7 move downward and the platform 1 moves back down.

In use, a user may stand on the platform 1 and raise the handle assembly 3 until the cable 5 is taut. Once the cable 5 is taut, the user may raise the handle assembly 3 further to lift the rods 7. As the handle assembly 3 is raised, the wheels 9 travel along the base 11 towards the outer edges of the platform 1 and the rods 7 raise the platform 1. The rods 7 are preferably inserted parallel to one another at each corner of the platform 1 so that the rods 7 extend outward from the corners of the short side of a rectangular platform 1 and in line with the long edges of the platform 1. With this arrangement, the platform 1 may be raised uniformly and the platform 1 is restricted from moving forward-to-back. As the platform 1 rises, the hinged body 13 expands in an accordion like manner, which prevents the platform 1 from shifting side-to-side and allows the user to stand on the platform 1 without exerting excessive effort to stay balanced. When the cable 5 is lowered, the wheels 9 travel along the base 11 back towards the center of the apparatus, which lowers the rods 7, and in turn, lowers the platform 1.

Thus, the user's actions of lifting a handle assembly 3, such as a bar, with his or her arms will allow a full range of exercise motion up and down with the difficulty set by body weight and principles of variable leverage. A user can also vary his or her position relative to the handle assembly 3 to accomplish many different exercises. For example, the user can attach either a cross-bar or alternate shaped handles as the handle assemblies 3, so the user, while standing on the platform 1, may perform bicep curls, shoulder presses, military presses, bent over rows, deltoid raises, or bent over side lateral raises. The user may also place a bar over his or her shoulder or hold u-shaped handles at shoulder height and perform squats or calf raises while standing on the platform 1. The user may shorten 5 the cable and lie on his or her back on the platform 1 and perform a bench press, a fly with alternate or u-shaped handles, or sit-ups. With the cable 5 shortened, the user may also perform deadlifts. A user may also place his or her hands on the platform 1 and place a bar over his or her shoulders and perform push-ups with resistance. These examples are just a few of the exercises available to a user utilizing this portable exercise device.

Still referring to FIG. 1, the resistance fasteners 15 may be a hinge that receives the rod 7, wherein the rod can slide within the resistance fastener 15 and once the desired resistance is achieved the resistance fastener 15 may lock the rod 7 in place via a fastening means known to one of skill in the art. The resistance fastener 15 may be composed of a metal, alloy, such as steel, or a plastic, such as polycarbonate or polypropylene.

Figure 2:
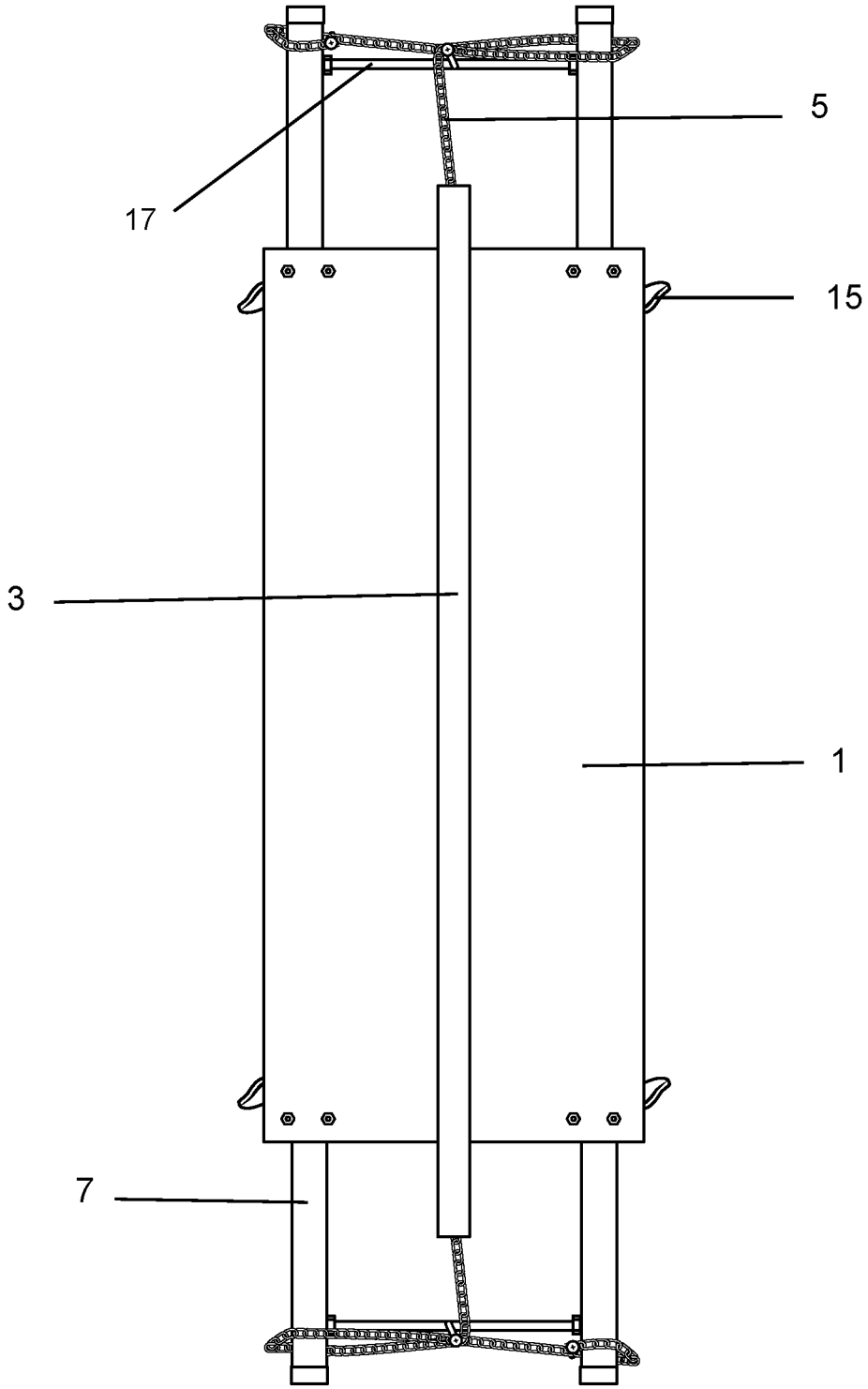
FIG. 2 is a top view of one embodiment of the portable exercise apparatus.

Referring to FIG. 2, in one embodiment, the platform 1 may be composed of a metal, alloy, such as steel, or a plastic, such as polycarbonate, polyethylene, or polypropylene. The platform 1 has enough surface area for a user to comfortably stand on the platform 1 with both feet planted and the platform 1, along with the hinged body 14 and the base 11, can withstand enough force to bear the weight of most humans.

Figure 3:
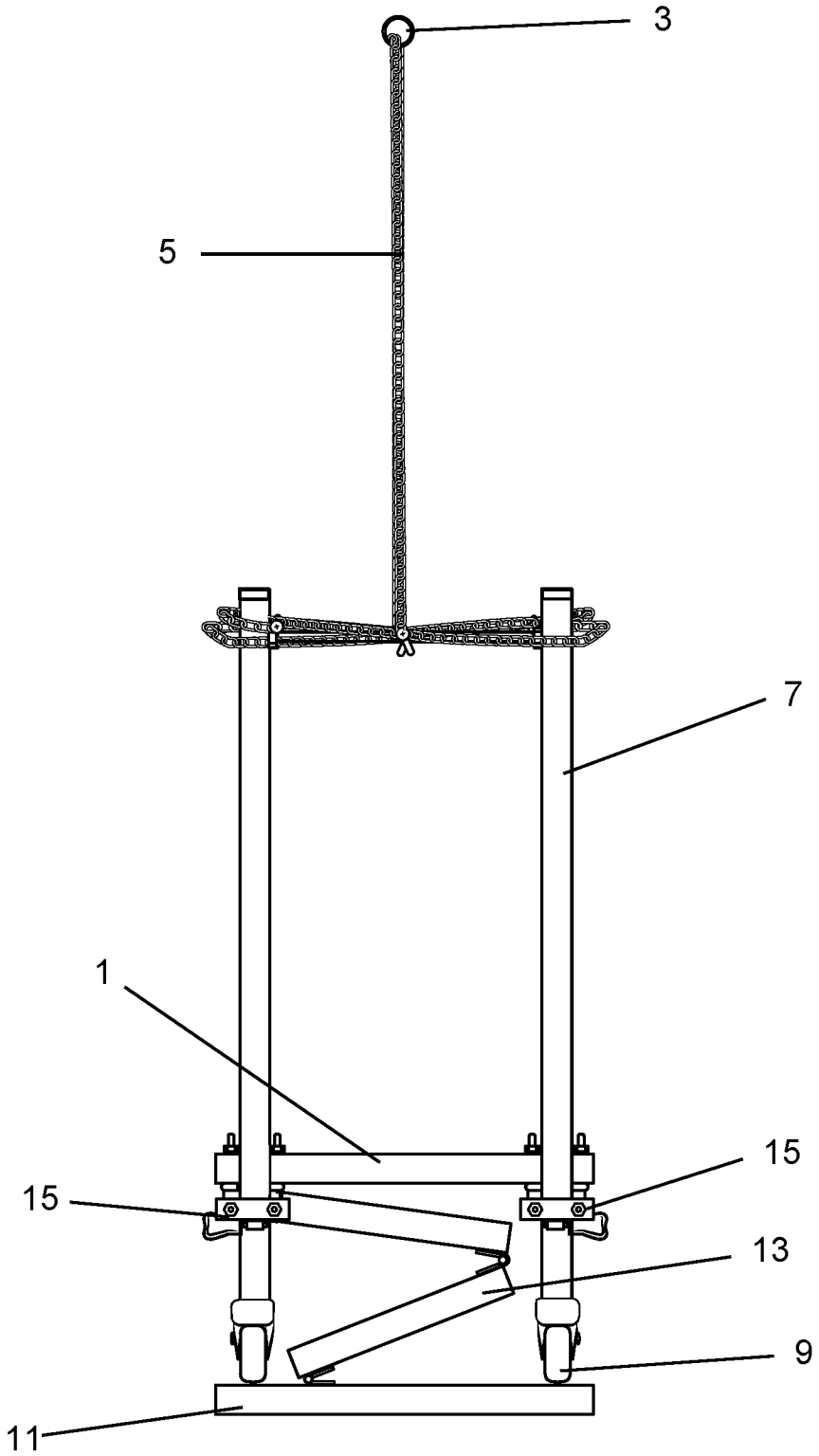
FIG. 3 is a side view of one embodiment of the portable exercise apparatus when it is extended.

Referring to FIG. 3, in one embodiment, a cable 5 is attached to the support segment between the parallel rods 7 on one end, and the other end has a means for an attachment, such as a carabiner. The cable 5, via the attachment means, can attach to a variety of handle assemblies. For example, in one embodiment, the handle assembly 3 may be a U-shaped handle, or, in another embodiment, each cable can attach to one end of a bar via carabiners.

In one embodiment, one end of the cable may also feature a cable housing assembly, wherein the housing assembly provides a spindle and a reservoir for the cable to retract into and out of. Referring to FIG. 1, the cable housing assembly (not shown) allows the user to variably adjust the length of the cable 5 from C to D to accommodate the anticipated exercise movement. The cable housing assembly may also have a locking mechanism to ensure that the cable 5 does not extend or retract and stays at the desired length. The cable 5 may be composed of a metal, alloy, such as steel.

Still referring to FIG. 3, in one embodiment, the base 11 may be composed of a metal, alloy, such as steel, or a plastic, such as polycarbonate or polypropylene. The hinged body 13, is comprised of two rectangular blocks that are connected to each other via hinges that allow the two blocks to open up in a clam like or accordion like fashion. The upper hinged block is attached to the bottom of the platform 1 by at least one hinge and the lower hinged block is attached to the top of the base by at least one hinge. The upper and lower blocks of the hinged body may be composed of a metal, alloy, such as steel, or a plastic, such as polycarbonate or polypropylene.

Still referring to FIG. 3, the wheels 9 may attached to the rod 7 by any fastening means known by one of skill in the art. Furthermore, the wheels 9 may be composed of polyurethane.

Figure 4:
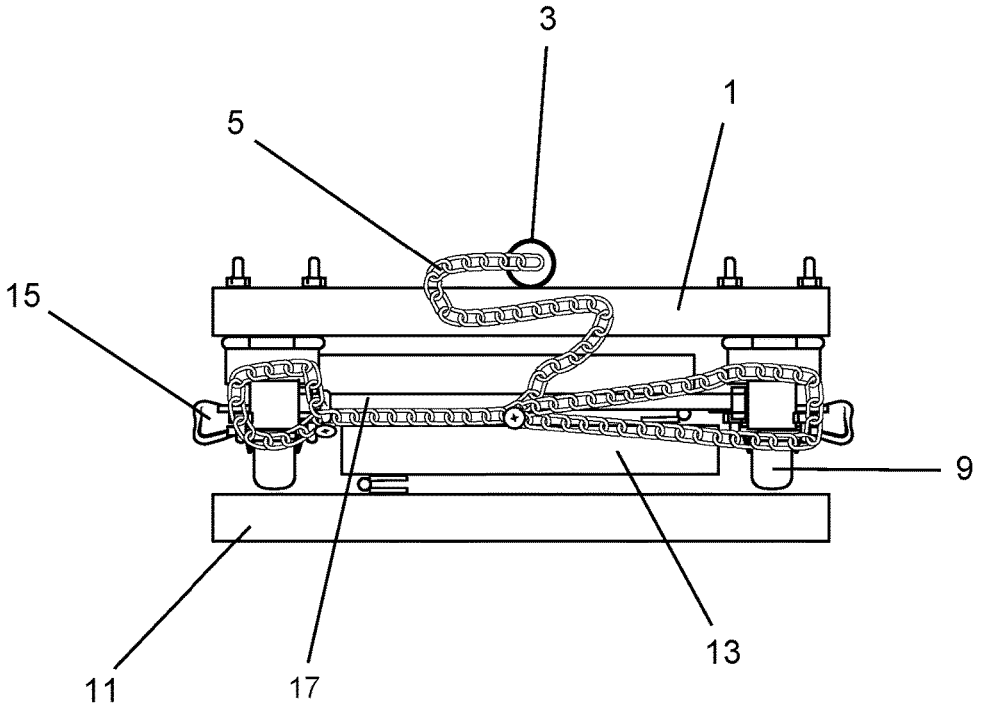
FIG. 4 is a side view of one embodiment of the portable exercise apparatus when it is collapsed.

Referring to FIG. 4, in one embodiment, the portable exercise apparatus is easily transformed into a compact unit that may be easily stored in a travel case, duffel, or under a bed. The handle assembly 3 may be detached from the cables 5. Additionally, the cables 5 may retract into a cable housing reservoir. Moreover, the rods 7 are telescoping so they may retract to their shortest length. In another embodiment, the rods 7 have the ability to fold up or fold out. Furthermore, the resistance fasteners 15 may be loosened and the rods 7 may slide under the platform 1 between the platform 1 and the base 11. In one embodiment, fasteners may be attached to at least one side of the apparatus and used to secure the apparatus together by extending from the platform 1 to the base 11 or vice versa. When completely bundled, the portable exercise apparatus may resemble a rectangular box.

In one embodiment, the platform 1 may feature a cushioned embodiment, which may allow the user to comfortable lay with his or her back on the platform 1 and perform various exercises while lying down. The cushioned embodiment of platform 1 may also allow a user to sit more comfortably on the platform 1 and perform exercises while seated.

In one embodiment, the portable exercise device may feature four legs that fold out and the device may allow the user to use cables 5 and various handle assemblies in a manner that mimics the downward force that some exercise machines possess.

Other features will be understood with reference to the drawings. While various embodiments of the method and apparatus have been described above, it should be understood that they have been presented by way of example only, and not of limitation. Likewise, the various diagrams might depict an example of an architectural or other configuration for the disclosed method and apparatus, which is done to aid in understanding the features and functionality that might be included in the method and apparatus. The disclosed method and apparatus is not restricted to the illustrated example architectures or configurations, but the desired features might be implemented using a variety of alternative architectures and configurations. Indeed, it will be apparent to one of skill in the art how alternative functional, logical or physical partitioning and configurations might be implemented to implement the desired features of the disclosed method and apparatus. Also, a multitude of different constituent module names other than those depicted herein might be applied to the various partitions. Additionally, with regard to flow diagrams, operational descriptions and method claims, the order in which the steps are presented herein shall not mandate that various embodiments be implemented to perform the recited functionality in the same order unless the context dictates otherwise.

Although the method and apparatus is described above in terms of various exemplary embodiments and implementations, it should be understood that the various features, aspects and functionality described in one or more of the individual embodiments are not limited in their applicability to the particular embodiment with which they are described, but instead might be applied, alone or in various combinations, to one or more of the other embodiments of the disclosed method and apparatus, whether or not such embodiments are described and whether or not such features are presented as being a part of a described embodiment. Thus the breadth and scope of the claimed invention should not be limited by any of the above-described embodiments.

Terms and phrases used in this document, and variations thereof, unless otherwise expressly stated, should be construed as open-ended as opposed to limiting. As examples of the foregoing: the term "including" should be read as meaning "including, without limitation" or the like, the term "example" is used to provide exemplary instances of the item in discussion, not an exhaustive or limiting list thereof, the terms "a" or "an" should be read as meaning "at least one," "one or more," or the like, and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that might be available or known now or at any time in the future. Likewise, where this document refers to technologies that would be apparent or known to one of ordinary skill in the art, such technologies encompass those apparent or known to the skilled artisan now or at any time in the future.

The presence of broadening words and phrases such as "one or more," "at least," "but not limited to" or other like phrases in some instances shall not be read to mean that the narrower case is intended or required in instances where such broadening phrases might be absent. The use of the term "module" does not imply that the components or functionality described or claimed as part of the module are all configured in a common package. Indeed, any or all of the various components of a module, whether control logic or other components, might be combined in a single package or separately maintained and might further be distributed across multiple locations.

Additionally, the various embodiments set forth herein are described in terms of exemplary block diagrams, flow charts and other illustrations. As will become apparent to one of ordinary skill in the art after reading this document, the illustrated embodiments and their various alternatives might be implemented without confinement to the illustrated examples. For example, block diagrams and their accompanying description should not be construed as mandating a particular architecture or configuration.

The claims filed herewith are incorporated by reference in their entirety into the specification as if fully set forth herein.

I claim:

1. A method of exercising comprising:

a) obtaining a portable exercise apparatus comprising:
- a platform with four corners;
- a base;
- a hinged body disposed between and coupled to the platform and base;
- a first resistance fastener on a first of the four corners of the platform;
- a second resistance fastener on a second of the four corners of the platform;
- a third resistance fastener on a third of the four corners of the platform;
- a fourth resistance fasteners on fourth of the four corners of the platform;
- a first rod secured by the first resistance fastener, the first rod having two ends with a first wheel on one of the ends of the first rod and a first parallel rod coupled to the other end of the first rod;
- a second rod secured by the second resistance fastener, the second rod having two ends with a second wheel on one of the ends of the second rod and the first parallel rod coupled to the other end of the second rod;
- a third rod secured by the third resistance fastener, the third rod having two ends with a third wheel on one of the ends of the third rod and a second parallel rod coupled to the other end of the third rod;
- a fourth rod secured by the fourth resistance fastener, the fourth rod having two ends with a fourth wheel on one of the ends of the fourth rod and the second parallel rod coupled to the other end of the fourth rod;
- at least one cable that is strung through a handle and that attaches at one end to the first parallel rod and at the other end to the second parallel rod;

b) positioning the first wheel and the second wheel on the base and under the platform so that the first and second rods extend outward from under one side of the platform and the first parallel rod is positioned away from the platform;

c) positioning the third wheel and the fourth wheel on the base and under the platform so that the third and fourth rods extend outward from under the other side of the platform and the second parallel rod is positioned away from the platform;

d) standing on the platform;

e) gripping the handle so that the cable is taut between the first parallel rod and the second parallel rod; and, f) moving the handle assembly upward or downward so that a force is exerted through the cable to the first and second parallel rods and the four rods each lever against the associated resistance fasteners to cause the wheels to move over the base and the hinged body to hinge, wherein said four rods move said platform upward or downward respectively.

2. The method of claim 1, wherein the upward or downward motion is used to perform an exercise from the group of exercises consisting of: bicep curls; bench presses; squats;

deadlifts; shoulder presses; bent over rows; deltoid raises; bent over side lateral raises; flys; calf raises; and push-ups.

3. The method of claim 1, further comprising adjusting leverage by adjusting a position of one of the resistance fasteners along any of the first, second, third, or fourth rods.

* * * * *